US006428151B1

(12) United States Patent
Yi et al.

(10) Patent No.: US 6,428,151 B1
(45) Date of Patent: Aug. 6, 2002

(54) INKJET PRINT HEAD AND METHOD OF MANUFACTURING THE SAME

(75) Inventors: Jonghoon Yi, Seoul; Jaekyun Lee; Jaebeom Choi, both of Kyonggi-do, all of (KR)

(73) Assignee: LG.Philips LCD Co., Ltd., Seoul (KR)

( * ) Notice: Subject to any disclaimer, the term of this patent is extended or adjusted under 35 U.S.C. 154(b) by 26 days.

(21) Appl. No.: 09/594,814

(22) Filed: Jun. 16, 2000

(30) Foreign Application Priority Data

Jun. 16, 1999 (KR) ..... 99-22595

(51) Int. Cl.[7] ..... B41J 2/045; B41J 2/14; B41J 2/16

(52) U.S. Cl. ..... 347/68; 347/47

(58) Field of Search ..... 347/68, 47, 45, 347/40

(56) References Cited

U.S. PATENT DOCUMENTS 5,481,289 A * 1/1996 Arashima et al. ..... 347/93
6,000,789 A * 12/1999 Takagi et al. ..... 347/86
6,303,042 B1 * 10/2001 Hawkins et al. ..... 216/27

* cited by examiner

*Primary Examiner*—Thinh Nguyen
(74) *Attorney, Agent, or Firm*—Birch, Stewart, Kolasch & Birch, LLP

(57) ABSTRACT

An inkjet print head includes a nozzle, and an ink pool temporarily holding a printing ink and a first screen. The first screen has at least a convex bar column, the bar column having a plurality of bars arranged in a longitudinal direction of the ink pool and spaced apart from each other. A piezo element pumps the printing ink from the ink pool to the nozzle.

10 Claims, 5 Drawing Sheets

INKJET PRINT HEAD AND METHOD OF MANUFACTURING THE SAME

CROSS REFERENCE

This application claims the benefit of Korean Patent Application No. 1999-22595, filed on Jun. 16, 1999, under 35 U.S.C. § 119, the entirety of which is hereby incorporated by reference.

BACKGROUND OF THE INVENTION

1. Field of the invention

The present invention relates to an inkjet print head and a method of manufacturing the same.

2. Description of Related Art

Inkjet print heads are widely used in various industrial fields since they can produce print at a relatively lower cost than a laser printer. They also can provide higher resolution than dot-matrix printers. For example, an inkjet print head is used to print a color filter layer of a liquid crystal display device.

However, since an inkjet print head uses a liquid ink, the liquid ink may become easily blurred on the printing paper or the printing plate and nozzles of the print head may become blocked because of the dregs in the liquid ink.

FIG. 1 shows a conventional inkjet print head. The print head 10 moves back and forth or right and left and sprays ink through nozzles 12 to print desired lines or data. However, since the print head 10 of the inkjet print uses a liquid ink, dregs of the liquid ink may remain inside the nozzle 12.

FIG. 2 shows a configuration of the print head. As shown in FIG. 2, the print head comprises an ink pool 14, a plurality of screens 16, and a piezo element 18. The ink pool 14 holds the printing ink, and the screens 16 are arranged between the ink pool 14 and the piezo element 18. The piezo element 18 serves to pump the printing ink from the ink pool 14 to the nozzle 12 through a channel 20 according to a predetermined controlling signal from the external drive circuit (not shown). The piezo element 18 further serves to forward the printing ink to a direction of an arrow "a". At this time, a lower portion of the piezo element 18 secures a big area enough to provide the piezo element 18 with a working space. Further, the channel 20 is connected with the lower portion of the piezo element 18 and becomes narrow in a direction away from the piezo element 18.

The screens 16 are formed on a wafer or a glass substrate 1, as shown in FIG. 3, and have a convex-gully shape. A concave portion between the screens 16 is a portion that is etched. The screens 16 serve to regulate the flow of the printing ink so that an excessive amount of the printing ink is not supplied from the ink pool 14 to the piezo element 18. Accordingly, a pumping energy of the piezo element 18 is uniformly provided to the nozzle 12, so that an appropriate amount of the printing ink is sprayed.

In the mean while, as shown in FIGS. 4A and 4B, since the nozzle 12 of the print head has a high hydrophilicity, i.e., a high water affinity as described above, dregs 24 of the printing ink 22 collect inside the nozzle 12, eventually clogging the nozzle 12. In addition, the nozzle 12 may be suddenly unblocked due to a pumping operation of the piezo element 18, leading to an over-spraying or a misprint.

To overcome the problems described above, several conventional methods of making the nozzle have a high hydrophobicity are known.

FIG. 5 shows a drop 3 of the printing ink on the metal plate 1. As shown in FIG. 5, the metal is considered to have a high hydrophobicity when a wet angle θ of ink drop 3 is greater than 45°. Metals having high hydrophobicity include Ti, Cu, and Au. As shown in FIG. 6, to prevent dregs of the printing ink from clogging the nozzles 12 of the print head 10, a process of either of depositing or coating a metal having a high hydrophobicity such as Ti, Cu and Au is additionally performed.

In another conventional approach, as shown in FIG. 7, first the print head 10*a* is located on a stage plate 21 and is secured by a head holder 25. Then, a fluorine-based polymer such as Cytop™ or Teflon is applied to the nozzle 12 while rotating print head 10*a* about a rotation axis 23, so that the nozzle 12 has a high hydrophobicity.

However, in the case of depositing or coating a metal having a high hydrophobicity, the metal coating film may be easily exfoliated so that the nozzle undesirably has a high hydrophilicity. Further, in the case of applying a hydrophobic material, i.e., a fluorine-base polymer to the nozzle, the nozzle of the print head may be clogged because the hydrophobic material has an inherent viscosity.

SUMMARY OF THE INVENTION

An object of the present invention is to provide a print head of an inkjet printer which has nozzles having a high hydrophobicity, and a method of manufacturing the same.

In order to achieve the above object, an inkjet print head includes a nozzle, an ink pool temporarily holding printing ink and a first screen. The first screen has at least a convex bar column, the bar column having a plurality of spaced apart bars arranged in a longitudinal direction of the ink pool. A piezo element pumps the printing ink from the ink pool to the nozzle.

A distance between the respective convex bars is about 25 to 30 μm. The present invention further includes a second screen having a plurality of spaced apart convex bars and a channel communicating with both the nozzle and the piezo element.

The channel becomes narrower in width in a direction away from the piezo element.

The present invention further provides a method of manufacturing an inkjet print head having a nozzle plate with a plurality of nozzles. The method includes depositing an amorphous silicon layer on the nozzle plate. The amorphous silicon layer is deposited on the nozzle plate using one of chemical vapor deposition (CVD) technique, sputtering, and physical vapor deposition (PVD).

The method according to the present invention also includes heating a petroleum-based material in a heater, and coating the vaporized petroleum-based material on the nozzle plate of the print head.

The petroleum-based material is heated using an electric furnace or inflammable fuel. The petroleum-based material is, for example, a paraffin wax.

BRIEF DESCRIPTION OF THE DRAWINGS

For a more complete understanding of the present invention and the advantages thereof, reference is now made to the following descriptions taken in conjunction with the accompanying drawings, in which like reference numerals denote like parts, and in which.

DETAILED DESCRIPTION OF PREFFERED EMBODIMENTS

Reference will now be made in detail to a preferred embodiment of the present invention, an example of which is illustrated in the accompanying drawings.

Figure 1:
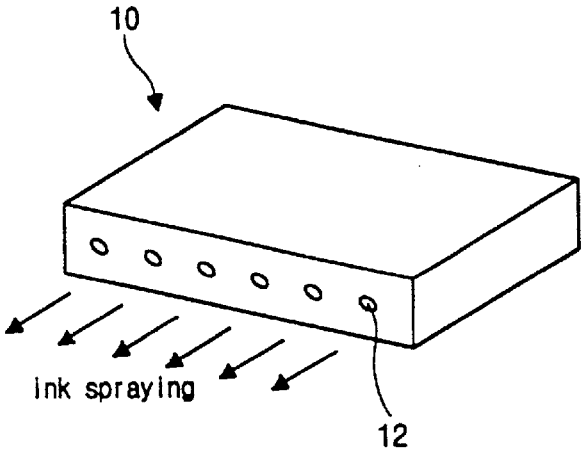
(RELATED ART) FIG.1
FIG. 1 is a perspective view illustrating a conventional inkjet print head.
Figure 2:
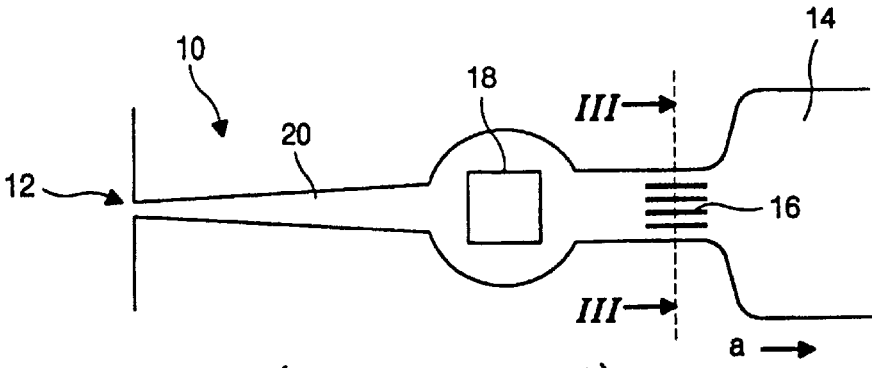
(RELATED ART) FIG.2
FIG. 2 is a plan view illustrating an inside configuration of the conventional inkjet print head.
Figure 3:
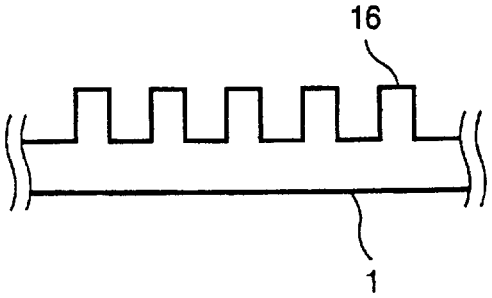
(RELATED ART) FIG.3
FIG. 3 is a cross sectional view taken along line III—III of FIG. 2.
Figure 4A:
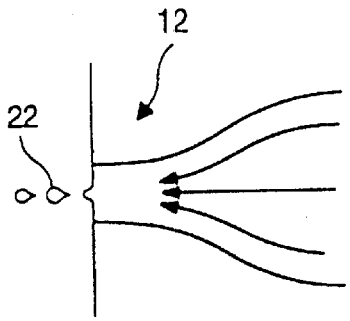
(RELATED ART) FIG.4A
FIGS. 4A and 4B are enlarged plan views illustrating a nozzle of the conventional inkjet print head.
Figure 4B:
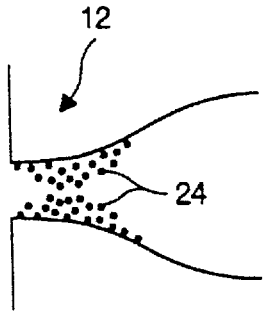
(RELATED ART) FIG.4B
Figure 5:
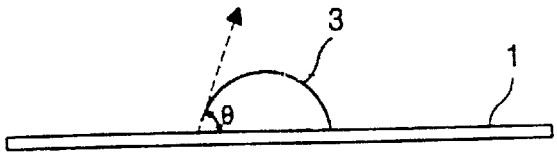
(RELATED ART) FIG.5
FIG. 5 is a cross sectional view illustrating a wet angle of a drop of a printing ink.
Figure 6:
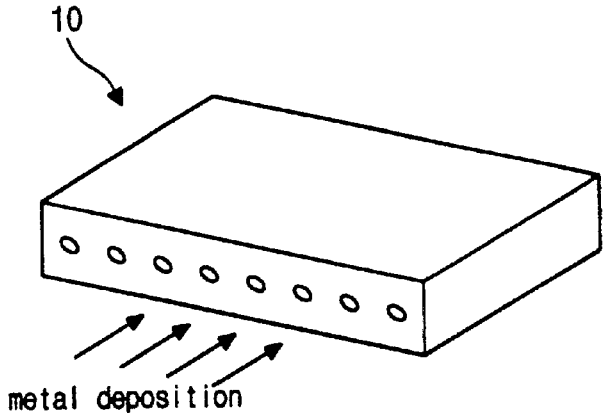
(RELATED ART) FIG.6
FIG. 6 is a perspective view illustrating a first method of manufacturing a hydrophobic nozzle of the inkjet print head according to the prior art.
Figure 7:
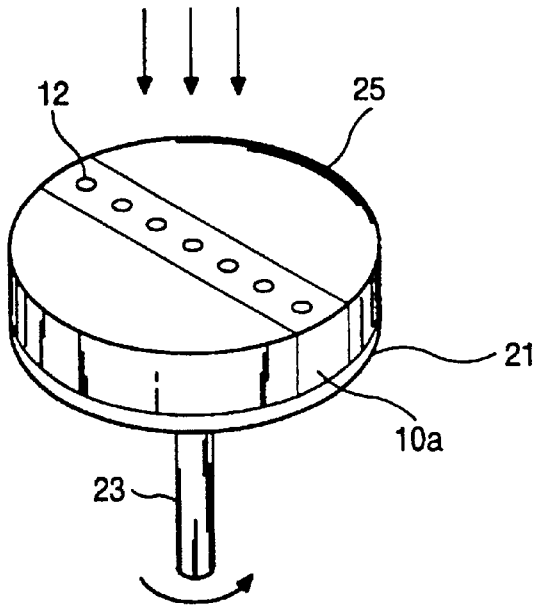
(RELATED ART) FIG.7
FIG. 7 is a perspective view illustrating a second method of manufacturing a hydrophobic nozzle of the inkjet print head according to the prior art.
Figure 8:
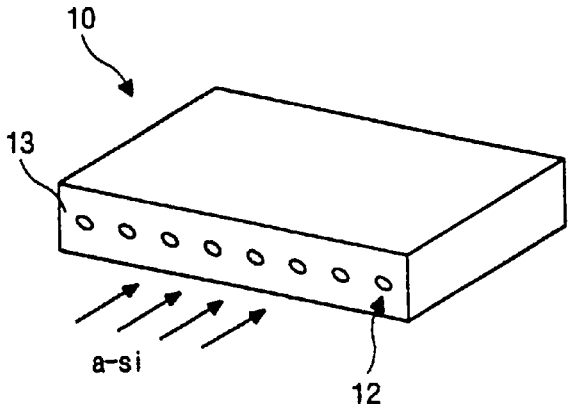
FIG. 8 is a perspective view illustrating a method of manufacturing a hydrophobic nozzle of an inkjet print head according to a first embodiment of the present invention.

As shown in FIG. 8, to make a hydrophobic nozzle 12 of an inkjet print head 10, an amorphous silicon layer with a thickness of hundreds of angstrom is deposited on a nozzle plate 13. Therefore, the nozzle 12 is highly hydrophobic. The nozzle 12 has a diameter of tens of $\mu$m. As a result, clogging of the nozzles 12 by printing ink dregs is prevented. Deposition of the amorphous silicon layer on the nozzle plate 13, as described above, is performed using chemical vapor deposition (CVD), sputtering, or physical vapor deposition (PVD).

Figure 9:
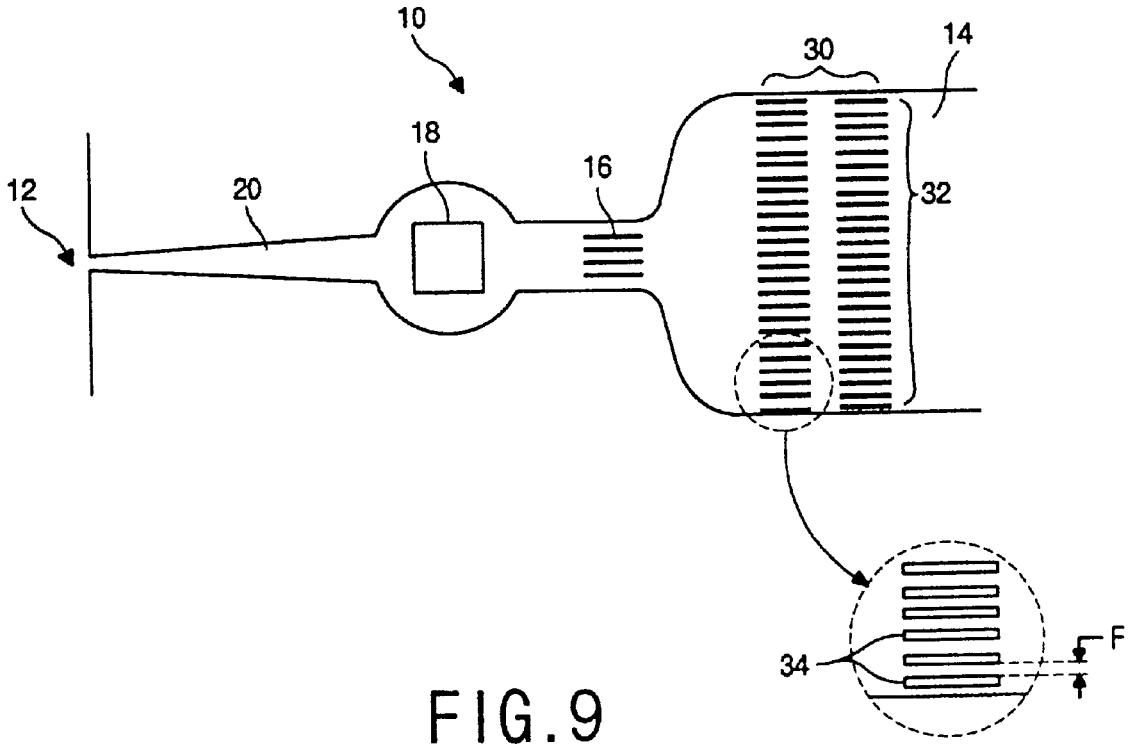
FIG. 9 is a plan view illustrating a method of manufacturing a hydrophobic nozzle of an inkjet print head according to a second embodiment of the present invention.

A second method to make a hydrophobic nozzle 12 of an inkjet print head 10 is shown in FIG. 9. FIG. 9 shows an inside configuration of an inkjet print head according to a second embodiment of the present invention. The inkjet print head 10 includes an ink pool 14, first screens 16, and a piezo element 18. The ink pool 14 also has a second screen 30 and holds the printing ink temporarily. The first screens 16 are arranged between the ink pool 14 and the piezo element 18. The piezo element 18 pumps the printing ink from the ink pool 14 to the nozzle 12 through a channel 20 according to a predetermined controlling signal from the external drive circuit (not shown). The piezo element 18 has a lower portion to secure a big area enough to provide the piezo element 18 with an working space. Further, the channel 20 is connected with the lower portion of the piezo element 18 and becomes narrow in a direction away from the piezo element 18.

The second screen 30 filters off tangled pigment particles of the printing ink. The second screen 30 includes at least a convex or concave bar column 32 having a plurality of convex or concave bars 34 arranged in a longitudinal direction of the ink pool 14. The second screen 30 is formed by etching and patterning a glass substrate or a wafer. A distance F between the plurality of the convex or concave bars 34 is about tens of $\mu$m and preferably 25 to 30 $\mu$m, whereas a pigment of the printing ink is generally 5000 angstrom in size. Thus, when pigments in the printing ink get tangled, the tangled pigment particles can be filtered by the second screen 30. Therefore, the nozzles 12 of the inkjet print head 10 are not clogged because the tangled pigment particles of the printing ink are not passed to nozzles 12.

Figure 10:
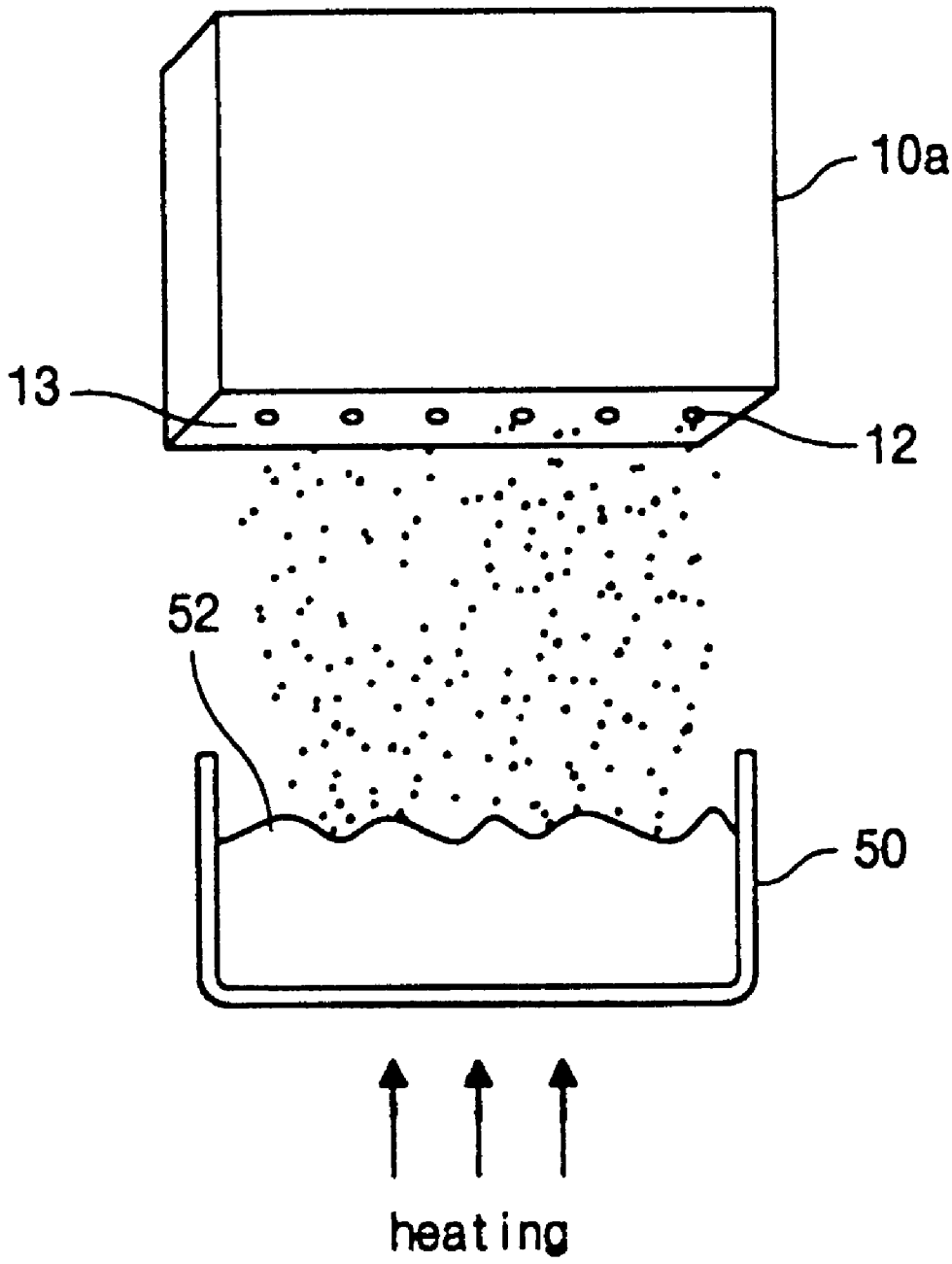
FIG. 10 is a perspective view illustrating a method of manufacturing a hydrophobic nozzle of the inkjet print head according to a third embodiment of the present invention.

A third method to make a hydrophobic nozzle 12 of an inkjet print head 10 includes depositing a petroleum-based material on a nozzle plate 13. As shown in FIG. 10, a petroleum-based material 52 in a heater 50, (for example, a paraffin wax), is heated and vaporized so that the vaporized petroleum-based material 52 is coated on the nozzle plate 13 of the inkjet print head 10*a*, whereupon the nozzles 12 have a high hydrophobicity.

The heating process of the petroleum-based material 52 is performed using, for example, an electric furnace or an inflammable fuel. An electric furnace is preferably used.

As described hereinbefore, according to the preferred embodiments of the present invention, nozzle clogging by the dregs of the printing ink does not occur because the nozzles of the inkjet print head have a high hydrophobicity.

While the invention has been particularly shown and described with reference to preferred embodiments thereof, it will be understood by those skilled in the art that the foregoing and other changes in form and details may be made therein without departing from the spirit and scope of the invention.

What is claimed is:

1. An inkjet print head including:

an ink nozzle;

an ink pool for holding ink;

a channel corresponding to said ink nozzle and extending between said ink nozzle and said ink pool;

a first screen located between said ink nozzle and said ink pool;

a second screen located upstream from said first screen; and an ink pumping element constructed and arranged to pump ink from said ink pool to said ink nozzle, wherein said second screen comprises a plurality of spaced apart second bar members aligned with an ink flow direction.

2. The print head according to claim 1, wherein said ink pumping element is a piezo electric element.

3. The print head according to claim 1, wherein said first screen comprises a plurality of spaced apart first bar elements each aligned with an ink flow direction.

4. The print head according to claim 3, wherein a distance between respective said first bar members is between about 25 $\mu$m and 30 $\mu$m.

5. The print head according to claim 1, wherein said channel becomes narrow in a direction toward said ink nozzle.

6. The print head according to claim 1, wherein said second screen comprises at least two groups of spaced apart second bar members, each said group being spaced apart from each other in an ink flow direction.

7. The print head according to claims 1, wherein a distance between respective said second bar members is between about 25 m and 30 m.

8. The print head according to claim 1, wherein an interior surface of said ink nozzle is hydrophobic.

9. A nozzle plate for an ink jet print head, including at least one ink nozzle formed therethrough, said at least one ink nozzle having an amorphous silicon film coated on an interior surface of said at least one ink nozzle, thereby making said interior surface hydrophobic.

10. A nozzle plate for an ink jet print head, including at least one ink nozzle formed therethrough, said at least one ink nozzle having a petroleum-based material film deposited on an interior surface of said at least one ink nozzle, thereby making said interior surface hydrophobic.

* * * * *